US010903615B2

(12) United States Patent
Shi et al.

(10) Patent No.: US 10,903,615 B2
(45) Date of Patent: Jan. 26, 2021

(54) INSTALLATION TOOL AND METHOD FOR INSTALLING ELECTRICAL CONNECTOR

(71) Applicant: Tyco Electronics (Shanghai) Co. Ltd., Shanghai (CN)

(72) Inventors: Xuefeng Shi, Shanghai (CN); Jungfeng Wang, Shanghai (CN); Jiangping Wu, Shanghai (CN); Jin Xie, Shanghai (CN); Liangliang Xu, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 277 days.

(21) Appl. No.: 15/935,741

(22) Filed: Mar. 26, 2018

(65) Prior Publication Data

US 2018/0219344 A1 Aug. 2, 2018

Related U.S. Application Data

(63) Continuation of application No. PCT/IB2016/055713, filed on Sep. 23, 2016.

(30) Foreign Application Priority Data

Sep. 25, 2015 (CN) ..... 2015 1 0621180

(51) Int. Cl.
*H01R 43/00* (2006.01)
*H01R 43/027* (2006.01)
(Continued)

(52) U.S. Cl.
CPC ..... *H01R 43/027* (2013.01); *B25B 27/02* (2013.01); *B25B 27/04* (2013.01); *B25B 27/146* (2013.01); *B25D 1/00* (2013.01); *H01R 4/5083* (2013.01)

(58) Field of Classification Search
CPC ..... H01R 9/05; H01R 43/042; H01R 43/205; H01R 43/26; H05K 31/301; H05K 31/306
See application file for complete search history.

(56) References Cited

U.S. PATENT DOCUMENTS 3,257,499 A 6/1966 Broske
4,533,205 A * 8/1985 Frank ..... H01R 4/5083 439/783

(Continued)

FOREIGN PATENT DOCUMENTS

EP 0733440 A1 9/1996
WO 9840178 A1 9/1998

OTHER PUBLICATIONS

PCT Notification of Transmittal of the International Search Report and the Written Opinion of the International Searching Authority, International Search Report and Written Opinion of the International Searching Authority, dated Dec. 8, 2016, 15 pages.

*Primary Examiner* — Paul D Kim
(74) *Attorney, Agent, or Firm* — Barley Snyder

(57) ABSTRACT

An installation tool for forcibly inserting a first work piece into a fitting hole of a second work piece comprises a body, a holding head, a power lever, and a hammering tool. The body has a front end and a rear end opposite the front end in a longitudinal direction. The holding head is connected to the front end of the body and configured to hold the second work piece. The power lever is movably mounted on the body and extends in the longitudinal direction. The hammering tool is configured to hammer the power lever to exert an impact force on the power lever, the power lever pushing the first work piece in the longitudinal direction under the impact force to forcibly insert the first work piece into the fitting hole of the second work piece.

17 Claims, 3 Drawing Sheets

(51) Int. Cl.

| | |
|---|---|
| ***H01R 4/50*** | (2006.01) |
| ***B25B 27/14*** | (2006.01) |
| ***B25B 27/04*** | (2006.01) |
| ***B25B 27/02*** | (2006.01) |
| ***B25D 1/00*** | (2006.01) |

(56) References Cited

U.S. PATENT DOCUMENTS

| | | | | | |
|---|---|---|---|---|---|
| 4,722,189 | A * | 2/1988 | Center | H01R 43/0275 | 60/635 |
| 4,905,603 | A * | 3/1990 | McBain | B25B 27/0085 | 102/530 |
| 4,945,730 | A * | 8/1990 | Laney | B25C 1/008 | 227/10 |
| 5,337,566 | A * | 8/1994 | Lomastro | B25B 27/146 | 227/10 |
| 5,388,499 | A * | 2/1995 | Szyndlar | B25C 1/163 | 102/464 |
| 5,533,254 | A * | 7/1996 | Gallo | B21F 15/06 | 29/750 |
| 5,785,229 | A * | 7/1998 | Franzini | B23D 15/145 | 173/202 |
| 7,328,751 | B2 * | 2/2008 | Peterson | B25B 27/0085 | 173/1 |
| 8,597,064 | B2 * | 12/2013 | Lefavour | H01R 4/08 | 439/783 |
| 2006/0090912 | A1 | 5/2006 | Peterson et al. | | |
| 2011/0154652 | A1 | 6/2011 | Lefavour et al. | | |

* cited by examiner

INSTALLATION TOOL AND METHOD FOR INSTALLING ELECTRICAL CONNECTOR

CROSS-REFERENCE TO RELATED APPLICATIONS

This application is a continuation of PCT International Application No. PCT/IB2016/055713, filed on Sep. 23, 2016, which claims priority under 35 U.S.C. § 119 to Chinese Patent Application No. 201510621180.X, filed on Sep. 25, 2015.

FIELD OF THE INVENTION

The present invention relates to an installation tool and, more particularly, to an installation tool adapted to forcibly insert a first work piece into a second work piece by impact on the installation tool.

BACKGROUND

To transmit power, two wires are electrically connected; one electrical connector is generally used to electrically connect the two wires. The electrical connector comprises a wedge block made of metal and a C-type clamp made of metal. The two wires are first placed into a wedge fitting hole of the C-type clamp and the wedge block is then forcibly inserted into the wedge fitting hole of the C-type clamp by impact from an installation tool. After the wedge block is inserted into the wedge fitting hole of the C-type clamp, the two wires are clamped between the wedge block and the C-type clamp and electrically connected with each other via the wedge block and the C-type clamp.

Because a large impact force is required to insert the wedge block into the wedge fitting hole of the C-type clamp, a detonator is used in the prior art to provide an impact power to the installation tool. The detonator is generally received in a detonator cavity in the installation tool and then is detonated. A power lever of the installation tool pushes the wedge block under an impact force generated during explosion of the detonator to force the wedge block to be inserted into the wedge fitting hole of the C-type clamp.

It is necessary to provide a safety device to prevent the detonator from being detonated accidentally. The detonator and the additional requirement of the safety device complicate the structure of the installation tool. Further, complying with safety rules for using the detonator complicates the installation process using the installation tool and the detonator also creates difficulties in transportation and storage.

SUMMARY

An installation tool for forcibly inserting a first work piece into a fitting hole of a second work piece comprises a body, a holding head, a power lever, and a hammering tool. The body has a front end and a rear end opposite the front end in a longitudinal direction. The holding head is connected to the front end of the body and configured to hold the second work piece. The power lever is movably mounted on the body and extends in the longitudinal direction. The hammering tool is configured to hammer the power lever to exert an impact force on the power lever, the power lever pushing the first work piece in the longitudinal direction under the impact force to forcibly insert the first work piece into the fitting hole of the second work piece.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
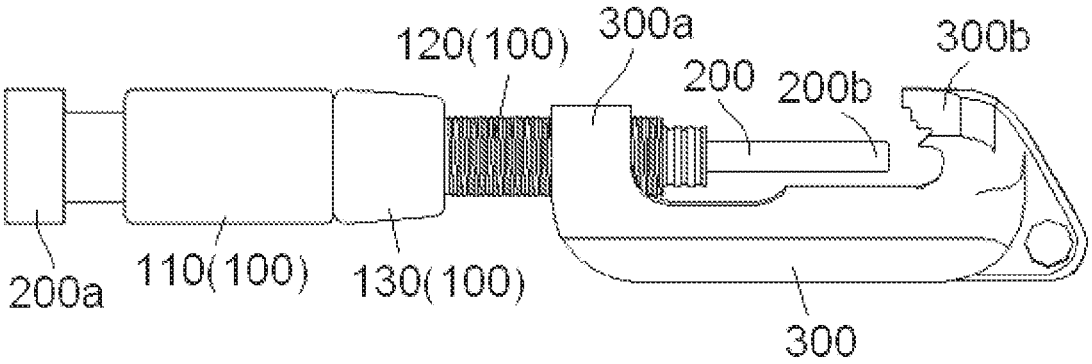
FIG. 1 is a side view of an installation tool.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

Figure 2:
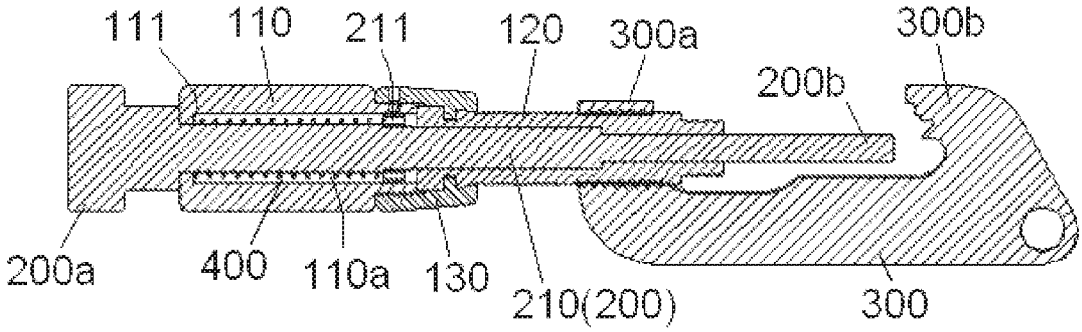
FIG. 2 is a sectional side view of the installation tool.
Figure 3:
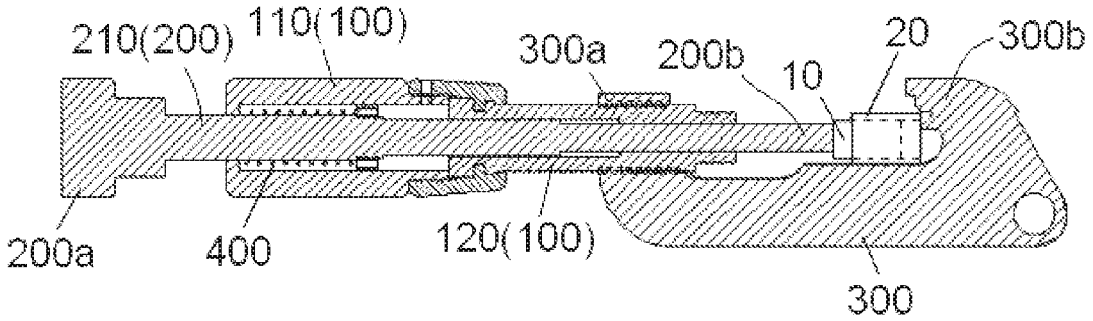
FIG. 3 is a sectional side view of the installation tool with a first work piece and a second work piece.
Figure 4:
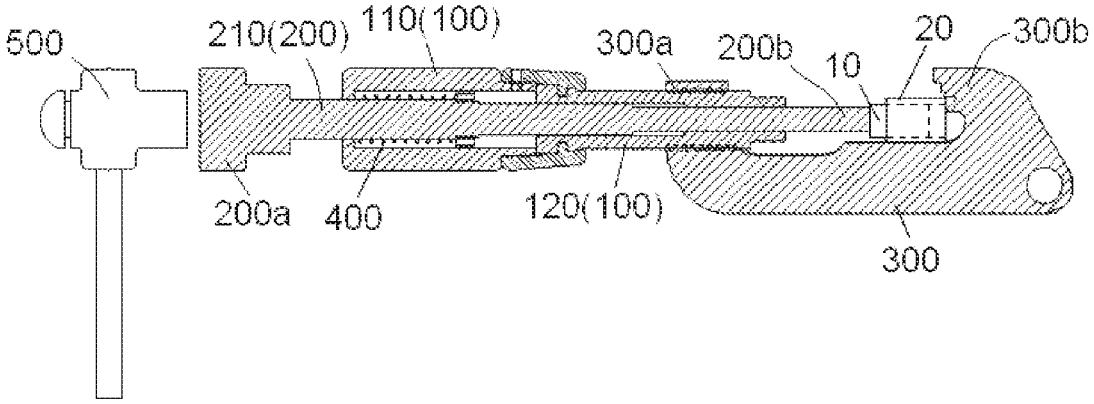
FIG. 4 is a sectional side view of the installation tool with a hammering tool and the first work piece pre-held in the second work piece.
Figure 5:
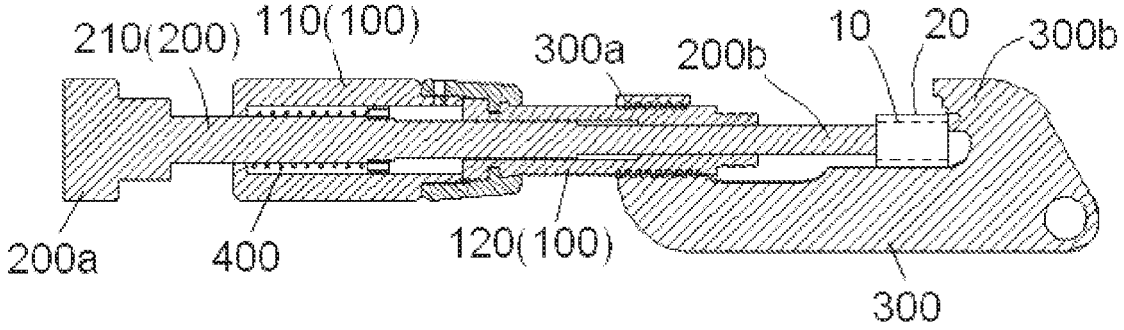
FIG. 5 is a sectional side view of the installation tool with the first work piece inserted into the second work piece.

An installation tool according to an embodiment is shown in FIGS. 1-5. The installation tool includes a body 100, a holding head 300, and a power lever 200. The installation tool is adapted to forcibly insert a first work piece 10 into a fitting hole of a second work piece 20 by impact, as shown in FIGS. 3-5.

The body 100 has a front end, a right end in FIGS. 1-5, and a rear end, the left end in FIGS. 1-5, opposite to each other in a longitudinal direction. The holding head 300 is connected to the front end of the body 100 and adapted to hold the second work piece 20. The power lever 200 is movably mounted onto the body 100 in the longitudinal direction.

The power lever 200, as shown in FIGS. 1 and 2, has a base end 200*a* extending from the rear end of the body 100 and a rod portion 210 extending from the base end 200*a* in the longitudinal direction. The rod portion 210 of the power lever 200 passes through the body 100 in the longitudinal direction, and a top end 200*b* of the rod portion 210 extends from the front end of the body 100.

The installation tool further comprises a hammering tool 500, shown in FIG. 4, adapted to hammer the base end 200*a* of the power lever 200 to exert an impact force onto the power lever 200. The hammering tool 500 may be a hammer or a hammer head. The top end 200*b* of the power lever 200 moves towards the first work piece 10 under the impact force exerted by the hammering tool 500 and strikes the first work piece 10 to force the first work piece 10 to be inserted into the fitting hole of the second work piece 20. In an embodiment, for easy hammering, a size of the base end 200*a* of the power lever 200 is larger than that of the rod portion of the power lever 200, and the base end 200*a* of the power lever 200 has a flat surface.

As shown in FIGS. 1 to 5, the body 100 has a compression spring 400 adapted to exert a push force to the power lever 200. The top end 200*b* of the power lever 200 is adapted to initially push the first work piece 10 into the second work piece under the push force exerted by the compression spring 400 so that the first work piece 10 is pre-held within the fitting hole of the second work piece 20 before striking the first work piece 10. The body 100 has a spring receiving cavity 110*a* within which the compression spring 400 is disposed. The power lever 200 passes through the spring receiving cavity 110*a* and the compression spring 400 in the longitudinal direction. As shown in FIG. 2, the power lever 200 is mounted with a blocking ring 211 thereon, and the compression spring 400 is compressed between a rear end wall 111 of the spring receiving cavity 110*a* and the blocking ring 211 to exert the aforementioned push force in the longitudinal direction.

The body 100, as shown in FIGS. 1-5, has a first portion 110 located at the rear end of the body 100, a second portion 120 located at the front end of the body 100, and a third portion 130 located between the first portion 110 and the second portion 120. The first portion 110 and the second portion 120 are connected by the third portion 130. In an embodiment, the first portion 110 and the second portion 120 are detachably connected by the third portion 130. In the shown embodiment, the third portion 130 has a coupling nut with internal threads, and the coupling nut is threaded onto the first portion 110 and the second portion 120.

The spring receiving cavity 110*a* is formed in the first portion 110 and the holding head 300 is threaded onto the second portion 120 as shown in FIGS. 1-5. The holding head 300 has a connection end 300*a* threaded onto the second portion 120 of the body 100. The second portion 120 of the body 100 has external threads thereon, the connection end 300*a* of the holding portion 300 is formed with a thread hole therein, and the second portion 120 of the body 100 is threaded into the thread hole of the connection end 300*a* of the holding portion 300. The holding head 300 has a holding end 300*b* opposite the connection end 300*a*. The holding end 300*b* is adapted to hold the second work piece 20. In the shown embodiment, the holding end 300*b* has a holding portion adapted to hook the second work piece 20 thereon.

In an embodiment, the first work piece 10 has a wedge block for electrically connecting electrical connectors of two wires and the second work piece 20 includes a C-type clamp of the electrical connector having a wedge fitting hole. After inserting the wedge block into the wedge fitting hole of the C-type clamp using the installation tool, the wires are clamped between the wedge block and the C-type clamp and electrically connected with each other by the wedge block and the C-type clamp. Generally, the C-type clamp has a first end and a second end having a diameter smaller than that of the first end; a diameter of the wedge fitting hole is gradually reduced from the first end to the second end. The holding head 300 of the installation tool is adapt to hook the second end of the C-type clamp having the smaller diameter to hold the C-type clamp, thereby preventing the C-type clamp from moving when the power lever 200 is struck.

A method for inserting the first work piece 10 of an electrical connector into a fitting hole of a second work piece 20 of the electrical connector using the installation tool will now be described in detail with reference to FIGS. 3-5. In an embodiment, the first work piece 10 is a wedge block and the second work piece 20 is a C-type clamp.

First, as shown in FIG. 3, the power lever 200 is pushed rearward. The compression spring 400 is gradually compressed to become short as the power lever 200 moves rearward, and the top end 200*b* of the power lever 200 gradually moves away from the holding end 300*b* of the holding head 300. When the power lever 200 moves rearward, the holding end 300*b* of the holding head 300 hooks an end of the second work piece 20, for example, an end of the C-type clamp having the smaller diameter. At this time, the first work piece 10 and the two wires have been pre-installed into a fitting hole of the second work piece 20.

The power lever 200 is then released to push the first work piece 10 onto the second work piece 20 under a push force exerted by the compression spring 400 so that the first work piece 10 and the two wires are pre-held in the fitting hole of the second work piece 20.

Then, as shown in FIG. 4, a base end 200*a* of the power lever 200 is hammered by a hammering tool 500 to exert an impact force to the power lever 200. A top end 200*b* of the power lever 200 moves forward and strikes the first work piece 10 under the impact force, such that the first work piece 10 is forcibly inserted into the fitting hole of the second work piece 20, as shown in FIG. 5. In an embodiment, it is possible to manually hammer the power lever 200 using the hammering tool 500. As compared to an impact force provided by a detonator, the installation tool is simpler in structure, easier to operate, and safer to use.

After inserting the first work piece 10 into the fitting hole of the second work piece 20 using the installation tool, the two wires are clamped between the first work piece 10 and the second work piece 20 and electrically connected with each other via the first work piece 10 and the second work piece 20. In order to realize a good electrical connection, in an embodiment, the first work piece 10 and the second work piece 20 are both made of a metal material.

What is claimed is:

1. An installation tool for forcibly inserting a first work piece into a fitting hole of a second work piece, comprising:
   - a body having a front end and a rear end opposite the front end in a longitudinal direction, the body including a spring receiving cavity having a compression spring disposed therein;
   - a holding head connected to the front end of the body and configured to hold the second work piece;
   - a power lever movably mounted on the body and extending in the longitudinal direction, the power lever having a base end extending from the rear end of the body and a top end fixed with respect to the base end and extending from the front end of the body, the power lever extending through the spring receiving cavity and the compression spring in the longitudinal direction, wherein the compression spring is adapted to exert a push force on the power lever; and
   - a hammering tool configured to hammer the base end of the power lever to exert an impact force on the power lever, the top end of the power lever pushing the first work piece in the longitudinal direction under the impact force to forcibly insert the first work piece into the fitting hole of the second work piece.

2. The installation tool of claim 1, wherein the top end of the power lever is adapted to push the first work piece into a pre-held position in the fitting hole of the second work piece under the push force of the compression spring.

3. The installation tool of claim 2, wherein the first work piece and the second work piece are in the pre-held position prior to the hammering tool hammering the base end of the power lever.

4. The installation tool of claim 3, wherein the body includes:
   - a first portion located at the rear end of the body;
   - a second portion located at the front end of the body; and
   - a third portion connecting the first portion and the second portion.

5. The installation tool of claim 4, wherein the third portion defines a coupling nut with internal threads threaded onto the first portion for connecting the first portion to the second portion.

6. The installation tool of claim 4, wherein the spring receiving cavity is disposed in the first portion and the holding head is threaded onto the second portion.

7. The installation tool of claim 6, wherein the holding head has a connection end threaded onto the second portion and a holding end holding the second work piece.

8. The installation tool of claim 1, further comprising a blocking ring disposed on the power lever, the compression spring compressed between a rear end wall of the spring receiving cavity and the blocking ring.

9. The installation tool of claim 1, wherein the power lever has a rod portion extending through the body in the longitudinal direction.

10. The installation tool of claim 1, wherein the first work piece includes a wedge block of an electrical connector for electrically connecting a pair of wires.

11. The installation tool of claim 10, wherein the second work piece includes a C-type clamp of the electrical connector having a wedge fitting hole.

12. The installation tool of claim 11, wherein the pair of wires are clamped between the wedge block and the C-type clamp and electrically connected with each other via the wedge block and the C-type clamp.

13. The installation tool of claim 12, wherein the C-type clamp has a first end and a second end having a diameter smaller than the first end, a diameter of the wedge fitting hole gradually decreases from the first end to the second end.

14. The installation tool of claim 13, wherein the holding head is adapted to hook the second end of the C-type clamp having the smaller diameter to hold the C-type clamp.

15. The installation tool of claim 1, wherein the hammering tool is a hammer.

16. A method for electrically connecting a pair of wires with an electrical connector, comprising:

providing the electrical connector having a first work piece adapted to be inserted into a fitting hole of a second work piece;

providing an installation tool having:

a body with a front end, a rear end opposite the front end in a longitudinal direction, and a compression spring;

a holding head connected to the front end of the body and configured to hold the second work piece;

a power lever movably mounted on the body and extending in the longitudinal direction, the power lever having a base end extending from the rear end of the body and a top end extending from the front end of the body; and a hammering tool;

moving the power lever rearward to compress the compression spring;

pre-installing the first work piece and the wires into the fitting hole of the second work piece;

placing the first work piece, the second work piece, and the wires pre-installed together onto the holding head and hooking the holding head onto an end of the second work piece having a smaller diameter;

releasing the power lever so that the power lever moves forward under a push force of the compression spring to hold the first work piece and the wires in the fitting hole of the second work piece; and hammering the base end of the power lever with the hammering tool so that the power lever moves forward under the impact force of the hammering tool to forcibly insert the first work piece into the fitting hole of the second work piece, clamping the wires between the first work piece and the second work piece to electrically connect the wires.

17. An installation tool for forcibly inserting a first work piece into a fitting hole of a second work piece, comprising:

a body having a front end and a rear end opposite the front end in a longitudinal direction, the body including a spring receiving cavity having a compression spring disposed therein;

a holding head connected to the front end of the body and configured to hold the second work piece;

a power lever movably mounted on the body and extending in the longitudinal direction, the power lever having a base end extending from the rear end of the body and a top end extending from the front end of the body, the power lever extending through the spring receiving cavity and the compression spring in the longitudinal direction, wherein the compression spring is compressed between a rear end wall of the spring receiving cavity and a blocking ring mounted on the power lever and is adapted to exert a push force on the power lever; and a hammering tool configured to hammer the base end of the power lever to exert an impact force on the power lever, the top end of the power lever pushing the first work piece in the longitudinal direction under the impact force to forcibly insert the first work piece into the fitting hole of the second work piece.

* * * * *